US008104297B2

(12) United States Patent
Heger et al.

(10) Patent No.: US 8,104,297 B2
(45) Date of Patent: Jan. 31, 2012

(54) ICE PREPARATION UNIT, TRAY AND OPERATIONAL METHOD THEREFOR

(75) Inventors: Bernd Heger, Haunsheim (DE); Nathan Wrench, Cambridge (GB)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 246 days.

(21) Appl. No.: 11/795,586

(22) PCT Filed: Dec. 2, 2005

(86) PCT No.: PCT/EP2005/056424

§ 371 (c)(1),
(2), (4) Date: Sep. 3, 2008

(87) PCT Pub. No.: WO2006/076982

PCT Pub. Date: Jul. 27, 2006

(65) Prior Publication Data

US 2009/0025401 A1 Jan. 29, 2009

(30) Foreign Application Priority Data

Jan. 24, 2005 (DE) ..... 10 2005 003 237

(51) Int. Cl.
*F25C 5/08* (2006.01)

(52) U.S. Cl. ..... 62/73; 62/353

(58) Field of Classification Search ..... 62/351, 62/353, 66, 73, 340, 356; 219/552–553
See application file for complete search history.

(56) References Cited

U.S. PATENT DOCUMENTS

| | | | | |
|---|---|---|---|---|
| 2,493,900 | A | 1/1950 | Schaberg et al. | |
| 2,941,379 | A | 6/1960 | Nelson | |
| 2,968,168 | A | 1/1961 | Lippincot | |
| 3,010,292 | A * | 11/1961 | Newberry | 62/353 |
| 3,029,609 | A * | 4/1962 | Zearfoss, Jr. | 62/135 |
| 3,071,933 | A | 1/1963 | Shoemaker | |
| 3,180,103 | A | 4/1965 | Frohbieter | |
| 3,182,468 | A | 5/1965 | Archer | |
| 3,200,612 | A | 8/1965 | Frohbieter | |
| 3,254,505 | A | 6/1966 | DeTurk | |
| 3,357,200 | A * | 12/1967 | Connors | 62/349 |
| 3,362,181 | A | 1/1968 | Linstromb | |
| 3,383,876 | A | 5/1968 | Frohbieter | |

(Continued)

FOREIGN PATENT DOCUMENTS

CN 1540268 10/2004

(Continued)

OTHER PUBLICATIONS

International Search Report PCT/EP2005/056424.

*Primary Examiner* — Mohammad Ali
(74) *Attorney, Agent, or Firm* — James E. Howard; Andre Pallapies

(57) ABSTRACT

An ice-maker tray (1) has several compartments (4), which each have the form of a segment of a body of rotation. When the content of the compartments (4) is frozen, the tray (1) suspended in a frame (15) of an ice maker is pivoted about an axis, which is parallel to the axes of the segments of the body of rotation, until the openings of the compartments (4) face downwardly and the pieces of ice thawed by heating can slide out of the compartments.

19 Claims, 5 Drawing Sheets

U.S. PATENT DOCUMENTS

| | | | | |
|---|---|---|---|---|
| 3,618,335 | A | 11/1971 | Toma | |
| 3,908,391 | A * | 9/1975 | Wulke et al. | 62/137 |
| 3,952,539 | A | 4/1976 | Hanson et al. | |
| 4,142,378 | A | 3/1979 | Bright et al. | |
| 4,306,423 | A | 12/1981 | Webb et al. | |
| 4,628,698 | A | 12/1986 | Needham et al. | |
| 4,838,026 | A * | 6/1989 | Searl | 62/137 |
| 4,852,359 | A | 8/1989 | Manzotti | |
| 5,408,844 | A * | 4/1995 | Stokes | 62/351 |
| 5,582,754 | A | 12/1996 | Smith et al. | |
| 5,992,167 | A | 11/1999 | Hill et al. | |
| 6,067,806 | A | 5/2000 | Park | |
| 6,112,540 | A * | 9/2000 | Serrels et al. | 62/351 |
| 6,216,471 | B1 * | 4/2001 | Patrick et al. | 62/71 |
| 6,247,318 | B1 * | 6/2001 | Stensrud et al. | 62/74 |
| 6,314,745 | B1 | 11/2001 | Janke et al. | |
| 6,414,301 | B1 | 7/2002 | Borg, Jr. et al. | |
| 6,571,567 | B2 | 6/2003 | An et al. | |
| 6,658,869 | B1 | 12/2003 | Thornbrou | |
| 7,152,424 | B2 * | 12/2006 | Shoukyuu et al. | 62/351 |
| 2004/0177638 | A1 | 9/2004 | Onishi et al. | |
| 2004/0237564 | A1 | 12/2004 | Zevlakis | |
| 2005/0126202 | A1 * | 6/2005 | Shoukyuu et al. | 62/351 |

FOREIGN PATENT DOCUMENTS

| | | |
|---|---|---|
| DE | 26 48 177 | 4/1978 |
| JP | 5-280848 | 10/1993 |
| JP | 6-273014 | 9/1994 |
| JP | 7-19685 | 1/1995 |

* cited by examiner

ICE PREPARATION UNIT, TRAY AND OPERATIONAL METHOD THEREFOR

The present invention relates to an ice-maker tray with a plurality of compartments which are arranged in a number of rows and separated from one another by partition walls, an ice maker in which such a tray is usable and an operating method for such an ice maker.

BACKGROUND OF THE INVENTION

In the case of conventional automatic ice makers and ice-maker trays, such as, for example, known from U.S. Pat. No. 6,571,567 B2, the individual compartments in which the ice is produced are substantially block-shaped. This shape does indeed enable a good utilisation of space, but has the disadvantage that removal of the finished pieces of ice from the mould is difficult, since when a piece of ice begins to detach from the base of its compartment there arises between it and the base a cavity in which underpressure prevails. This keeps the piece of ice in its position as long as a pressure equalisation between this cavity and the environment is not produced.

In the case of an independent ice-maker tray not fixedly incorporated in an appliance a user can gain assistance in that when the pieces of ice are ready the user knocks out, with the open side of the compartments downwards, on a firm support. Such a brisk blow can readily detach the pieces of ice sufficiently far from the compartment base to enable flowing on of air. However, this solution is not satisfactory, since the pieces of ice usually also hit the support violently and in that case are scattered or even damaged.

This method for removing the pieces of ice from the mould is not usable for an automatic ice maker. A widespread approach for solving the problem of removal from the mould is here to mount at the ice-maker tray an electric heating device which is placed in operation when the pieces of ice are ready in the compartments, in order to thaw these at the surface. However, a satisfactory solution of the problem is also not thereby achieved, because the water film arising in the case of thawing has a tendency, due to capillary forces, to wet the entire surface at which the piece of ice and compartment are in contact. If the ice-maker tray with pieces of ice thawed at the surface is turned upside down then the own weight of the pieces of ice does indeed have the effect that these slightly move away from the compartment base, but the thereby created intermediate space is filled by water which has to be sucked away from the gaps between the ice block and the side walls of the compartment while overcoming the capillary forces arising there. As long as this water draws back from the gap between the piece of ice and the at least one side wall of the compartment towards the base it very consistently prevents penetration of air between the piece of ice and the base of the compartment. Removal from the mould can thereby initially be even more difficult than in the case of pieces of ice which are not thawed, as can be readily established experimentally if an ice-maker tray with only slightly thawed pieces of ice is hit on a support. Only when with an increase in thickness of the water layer a sufficiently wide intermediate space between the piece of ice and the walls of the compartment is created can air actually penetrate between the piece of the ice and the compartment base and the piece of ice drops out of the compartment.

Obviously this solution is also not completely satisfactory, because the necessity of partly thawing again already finished pieces of ice causes a not inappreciable energy consumption of the ice maker and it loads the energy balance of a refrigerating appliance in which such an ice maker is used.

SUMMARY OF THE INVENTION

The object of the invention is therefore to indicate an ice maker as well as a tray and an operating method therefor which enable a reliable and easy removal of the pieces of ice from the mould with minimum expenditure of energy.

The object is met on the one hand by an ice-maker tray with a plurality of compartments in which the compartments each have the form of a segment of a body of rotation. This shape allows displacement of the finished pieces of ice along the circumference of the segment without an intermediate space between the walls of the compartment and the piece of ice arising. Underpressures which can prevent removal from the mould consequently do not arise. Moreover, it enables removal of pieces of ice from the mould through exertion of pressure on a part of its free surface, which is not possible in the case of a conventionally shaped compartment.

The body of rotation is preferably a cylinder, because a quite good utilisation of space can be achieved with the cylinder shape.

The axes of the rotational body segments of all compartments are preferably parallel. Thus, a single pivot movement about the common axis suffices to let all pieces of ice, which have been thawed at the surface or loosened in another way, easily slide out of their compartments. Since in the case of the displacement of the pieces of ice along the circumferential surface of the segment of the body of rotation no intermediate space is produced also no capillary forces oppose a displacement of the pieces of ice, so that even a water layer of minimum thickness, in which the capillary forces are particularly effective is sufficient to render the pieces of ice readily removable from the mould.

Preferably the compartments of the ice-maker tray are arranged in at least one row and a wall extending above the upper edge of the compartments of the row and separating the intermediate spaces from one another is formed at a longitudinal side of each row of compartments and at least a part of the transverse sides thereof. This construction of the ice-maker tray makes it possible to bring this into an inclined state in which water filled into the compartments floods over the partition walls into a region adjoining the protruding wall so that exactly the same water state in all compartments can be achieved. If such a tray is, for freezing, pivoted into an upright state in which the partition walls extend substantially horizontally and are no longer flooded over, pieces of ice cleanly separated from one another and with exactly the same size can be produced.

Preferably the number of rows in the ice-maker tray is one. It is, in fact, conceivable to produce an ice-maker tray of the above-described kind with any number of rows, but in the case of such a tray the protruding walls would have to prevent the exchange of water between adjacent rows so that water from the other rows does not collect, in the inclined state, in the lowest row. A standardisation of the volumes of the pieces of ice is therefore possibly only within one row.

In order to achieve in the inclined state a sufficient cross-section for the passage of water between the compartments the wall should protrude at least 5 millimetres above the upper edge of the partition walls.

An electric heating device can be provided at the ice-maker tray in order to accelerate and facilitate removal of finished pieces of ice from the mould by surface thawing.

In order to achieve an intensive heat exchange with the environment, the tray can be provided with protruding heat exchange ribs. These ribs can at the same time serve for mounting a rod-shaped heating device inserted therebetween.

The object is further fulfilled by an ice maker with an ice-maker tray of the above-described kind and a frame in which the tray is pivotable about an axis between an upright setting in which the openings of the compartments face upwardly and an emptying setting in which the openings of the compartments face downwardly.

In order to make the ice maker compact, the centre axis of a notional smallest cylinder enclosing the tray is preferably selected as pivot axis.

The upper edges of the partition walls preferably lie above the pivot axis in the upright and tilted setting. A large cross-sectional area of the compartments with at the same time compact external dimensions of the ice maker can thereby be realised.

The object is further fulfilled by an operating method for the ice maker in which after freezing of the pieces of ice these are allowed to thaw at the surface and the tray is pivoted about an axis, which is parallel to the axes of the segments of the body of rotation, into a setting in which the openings of the compartments face downwardly.

BRIEF DESCRIPTION OF THE DRAWINGS

Further features and advantages of the invention are evident from the following description of examples of embodiment with reference to the accompanying figures, in which.

DETAILED DESCRIPTION OF THE EXEMPLARY EMBODIMENTS OF THE PRESENT INVENTION

Figure 1:
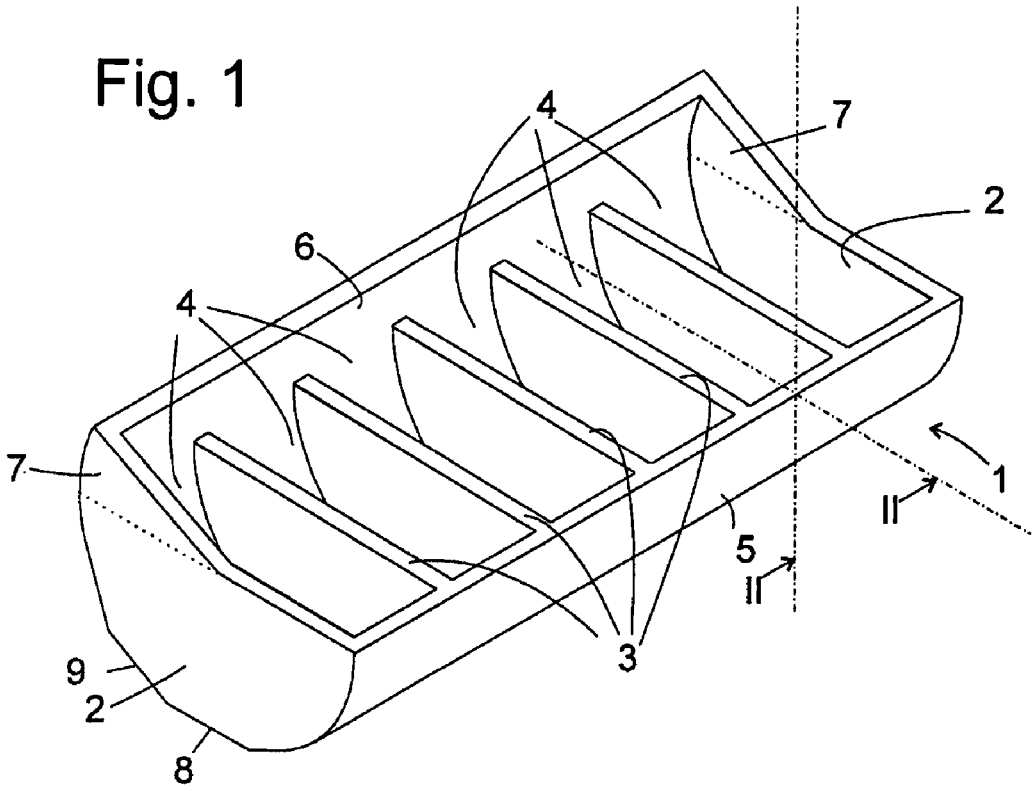
FIG. 1 shows a perspective view of an ice-maker tray according to a first elementary embodiment of the invention.

FIG. 1 is a perspective view of an elementary embodiment of an ice-maker tray according to the present invention, which is usable as an accessory in a freezing appliance. The tray 1 is a moulded part of solid plastics material, in the form of a channel with a semi-cylindrical base, which is closed at the ends thereof by respective transverse walls 2 and is subdivided by partition walls 3, which are arranged at uniform spacings, into a plurality of identically shaped compartments 4, here six units. Whereas the partition walls 3 at the longitudinal wall 5 facing the viewer adjoin flushly, the longitudinal wall 6 remote, from the viewer is prolonged above the upper edges of the partition walls 3. Whilst the partition walls 3 are exactly semicircular, the transverse walls 2 each have, in correspondence with the protrusion of the rearward longitudinal wall 6, a sector 7 going out beyond the semicircular shape.

Figure 2:
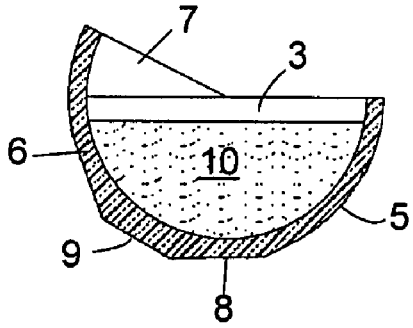
FIG. 2 shows a section through the ice-maker tray of FIG. 1 in upright state.

At the outer circumference of the tray 1 the longitudinal walls 5, 6 are connected by two planar surfaces 8, 9. In the setting of FIG. 1 the planar surface 8 forms the support surface of the tray 1. FIG. 2 shows a section through the tray 1 in the plane denoted by dot-dashed lines II, II in FIG. 1. The compartments 4 are here filled with water 10; the water level extends below the upper edges of the partition walls 3 parallel thereto.

Figure 3B:
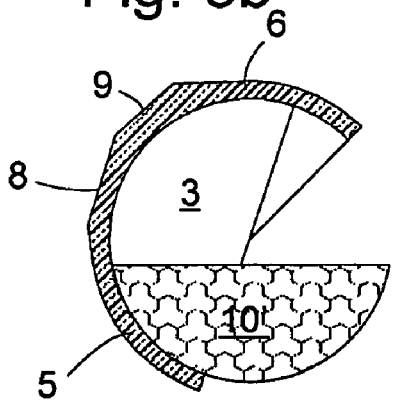
FIG. 3B shows a section through the ice-maker tray of FIG. 1 in an emptying setting.
Figure 3A:
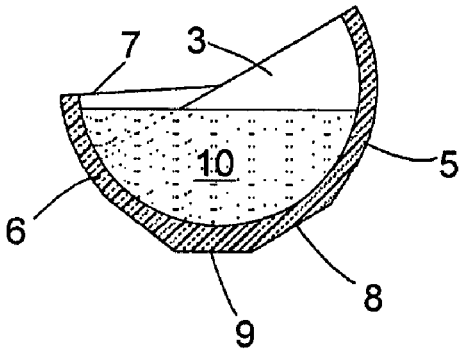
FIG. 3A shows a section through the ice-maker tray of FIG. 1 in tilted state.

FIG. 3A shows the same tray in a tilted state, resting on the planar surface 8 adjoining the elevated longitudinal wall 6. The water level is here parallel to the upper edges of the sectors 7 of the transverse walls 2, whilst the partition walls 3 are washed over by the water 10 on a part of their width, as indicated by a dashed line. In this setting water can flow freely from one compartment 4 to another so that the same water level sets in in all compartments. In this setting the tray 1 can be filled with water. In order to subsequently freeze the water into pieces cleanly separated from one another the tray 1 is placed in a freezing compartment in the setting shown in FIG. 2.

After freezing of the water in the compartments 4 the tray 1 is removed again from the freezer compartment in order to release the pieces of ice. For this purpose the pieces of ice can be detached from the walls by, for example, knocking or kneading the tray and subsequently be pushed out of the compartments by pressure with a finger on its free upper side in the vicinity of a longitudinal wall towards the other longitudinal wall.

Alternatively, the pieces of ice are allowed to thaw at the surface, for example by letting the tray 1 stand in air at room temperature or by immersion of the tray in hot water so that a water layer forms between the walls 2, 3, 5, 6 of the tray 1 and the pieces of ice. The thickness of the water layer can be very small; it is merely necessary for the direct contact between the pieces of ice 10' and the walls of the tray 1 to be eliminated. If the tray 1 is now pivoted about an axis perpendicular to the section plane of FIGS. 2, 3A the pieces of ice 10' sliding on a water film do not follow the pivot movement, as can be seen in FIG. 3B, but ultimately slide away over the edge of the longitudinal wall 5 and drop out of the tray 1.

Figure 4:
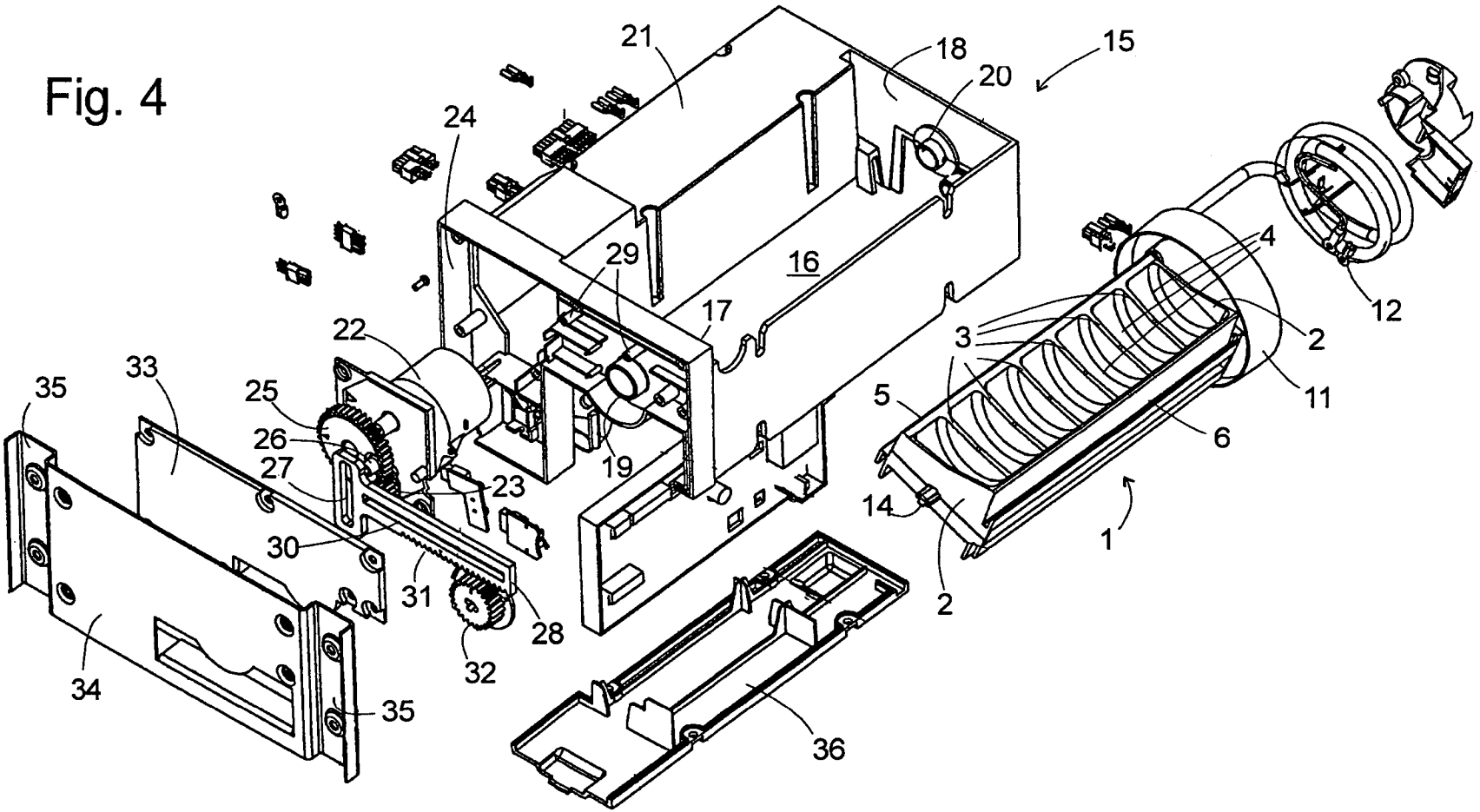
FIG. 4 shows an exploded illustration of an automatic ice maker according to a developed embodiment of the invention.

FIG. 4 shows an automatic ice cube maker according to the present invention in an exploded perspective view. Elements of this ice maker, which are functionally comparable with those of the tray of FIG. 1, are denoted by the same reference numerals. There can be recognised the tray 1, which is reproduced in an orientation approximately corresponding with the setting of FIG. 3A, with seven compartments 4 delimited from one another by partition walls 3. A longitudinal wall 5 remote from the viewer is flush with the upper edges of the partition walls 3, whilst a longitudinal wall 6 facing the viewer is prolonged above the upper edges of the partition walls 3. The tray 1 can be a plastics material moulded part, but preferably, due to the good thermal conductance capability, it is constructed as a cast part of aluminium.

Figure 12:
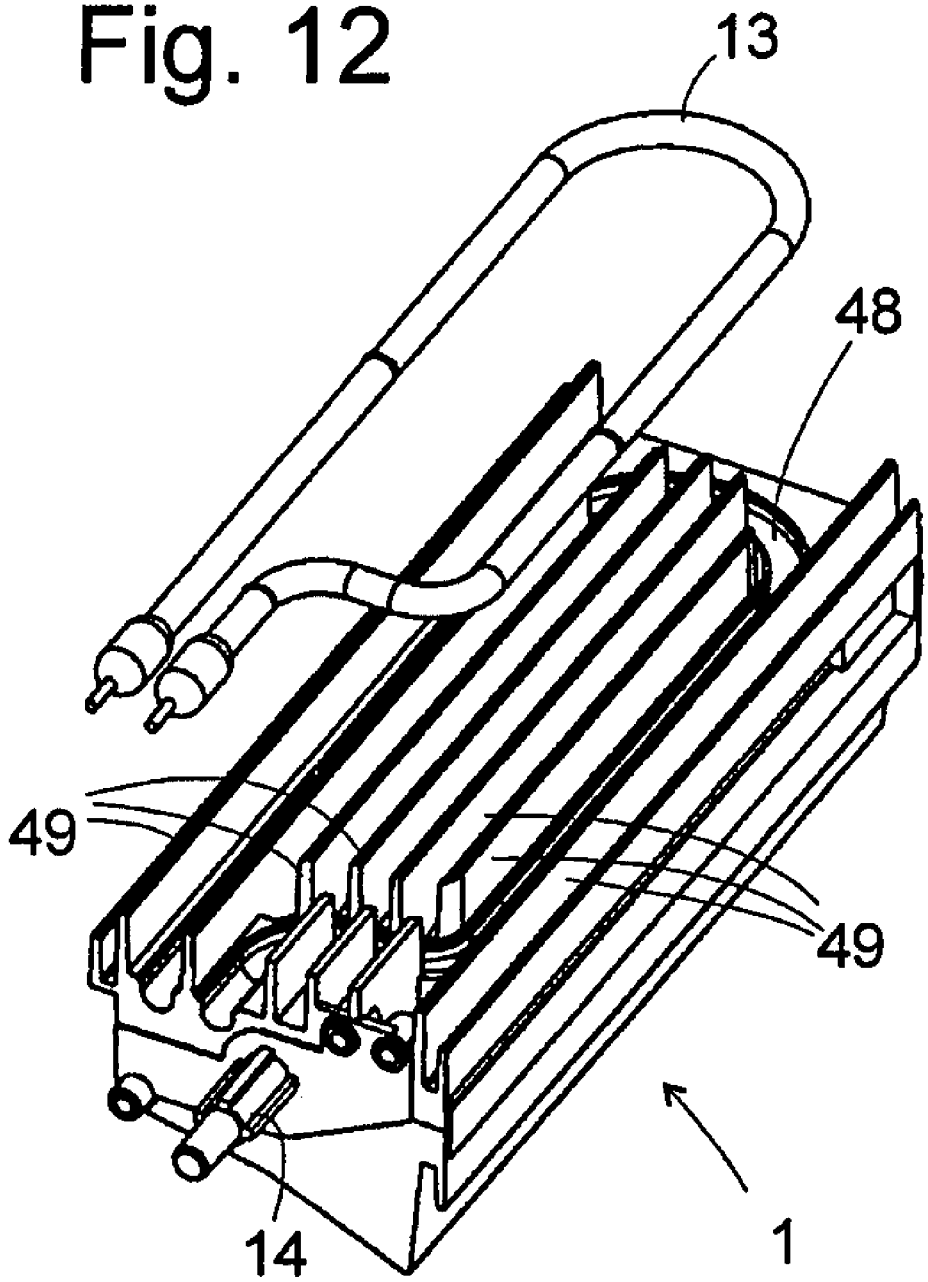
FIG. 12 shows a perspective, exploded view from below of the ice-maker tray.

A hollow cylinder 11 is mounted at one of the transverse walls 2 of the tray 1; it serves for protected accommodation of a coiled power supply cable 12 serving for supply of current to a heating device 13, which is not visible in the figure, accommodated at the underside of the tray 1 (see FIG. 12). The tray 1 lies completely within a notional prolongation of the circumferential surface of the hollow cylinder 11, which at the same time represents the smallest possible cylinder into which the tray fits. An axial spigot 14, which protrudes from the transverse wall 2 facing the viewer, extends on the longitudinal centre axis of the hollow cylinder 11.

A frame moulded from plastics material is denoted by 15. It has an upwardly and downwardly open cavity 16 which is provided for mounting of the tray 1 therein. Bearing bushes 19, 20 for the pivotable mounting of the tray 1 are formed at the end walls 17, 18 of the cavity 16. A longitudinal wall of the cavity 16 is formed by a box 21, which is provided for reception of a drive motor 22 as well as various electronic components for control of operation of the ice maker. Mounted on the shaft of the drive motor 22 is a pinion 23 which can be better seen in each of FIGS. 6, 7, 9 and 11 than in FIG. 2. When the ice maker is in fully mounted state the pinion 23 finds space in a cavity 24 of the end wall 17. It forms there, together with a gearwheel 25, a speed step-down transmission.

The gearwheel 25 carries a pin 26 which protrudes in axial direction and which is provided for engaging in a vertical slot 27 of an oscillatory body 28. The oscillatory body 28 is guided to be horizontally displaceable with the help of pins 29 which protrude from the end wall 17 into the cavity 24 and which engage in a horizontal slot 30 of the oscillatory body. A toothing 31 formed at a lower edge of the oscillatory body 28 meshes with a gearwheel 32, which is provided for the purpose of being plugged onto the axial spigot 14 of the tray 1 to be secure against rotation relative thereto.

A cover plate 33 screw-connected to the open side of the end wall 17 closes the cavity 24. A fastening flange 34 with straps 35 protruding beyond the end wall 17 serves for mounting the ice maker in a refrigerating appliance. A base plate 36 closes the box 21 at the bottom.

Figure 5:
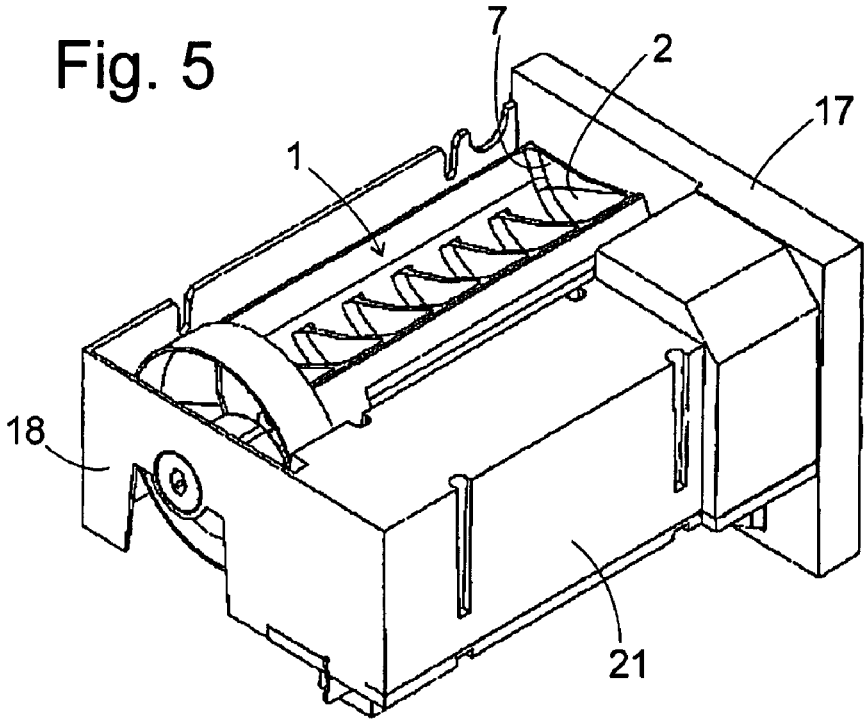
FIG. 5 shows a perspective view of the ice maker of FIG. 4 in assembled state with ice-maker tray in tilted setting.

FIG. 5 shows, as seen from the side of the end wall 18 and the box 21, the ice maker with the tray 1 in tilted setting in perspective view. The upper edges of the sectors 7 at the transverse walls 2 of the tray 1 extend horizontally.

Figure 6:
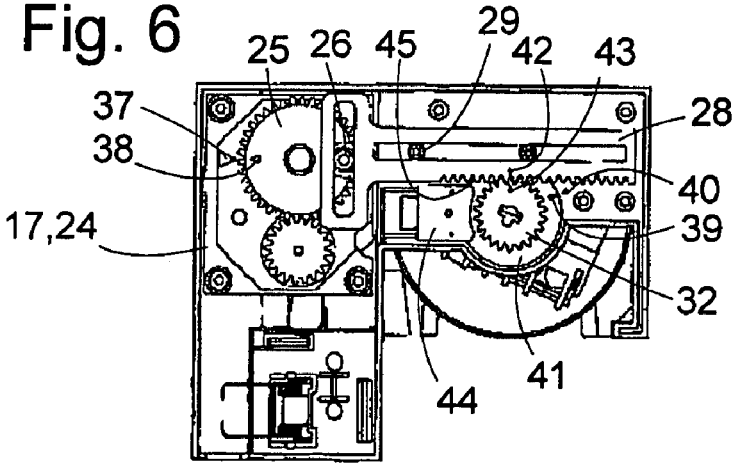
FIG. 6 shows a section through the ice maker of FIG. 5 in the plane denoted by VI-VI.

FIG. 6 shows a front view of the ice maker from the side of the end wall 17, wherein cover plate 33 and fastening flange 34 have been omitted in order to give free view into the cavity 24 of the end wall 17. The configuration shown here is that in which the ice maker is mounted together. Various markings indicate a correct positioning of individual parts relative to one another. A first pair of markings 37, 38 is disposed at the end wall 17 itself, or at the gearwheel 25 carrying the pin 26. When these markings 37, 38 are, as shown in the figure, aligned exactly with one another the pin 26 is disposed in a 3 o'clock setting, i.e. on the point, which lies furthest to the right in the perspective view of the figure, of its path which it can reach. The oscillatory body 28 plugged onto the pin 26 as well as onto the stationary pin 29 is disposed at the righthand reversal point of its path.

Markings 39, 40, which are aligned with one another, at a flange 41 of the gearwheel 32 protruding beyond the tooth rim and at the end wall 17 indicate a correct orientation of the gearwheel 32 and as a consequence thereof also of the tray 1 engaging by its axial spigot 14 in a cut-out, which is T-shaped in cross-section, of the gearwheel 32. A pair, which is redundant per se, of markings 42, 43 at the toothing 31 of the pivot body 28 and at the gearwheel 32 shows the correct positioning of gearwheel 32 and oscillatory body 31 with respect to one another.

Figure 7:
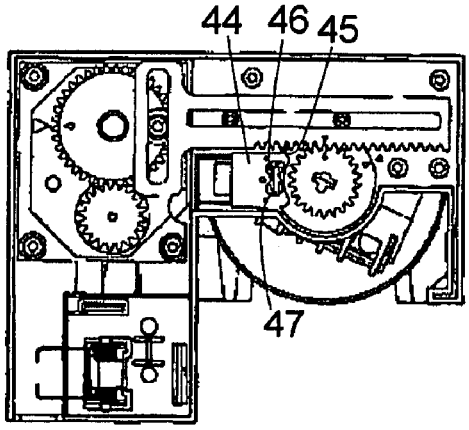
FIG. 7 shows the section of FIG. 6 with partly cut-away sensor housing.
Figure 10:
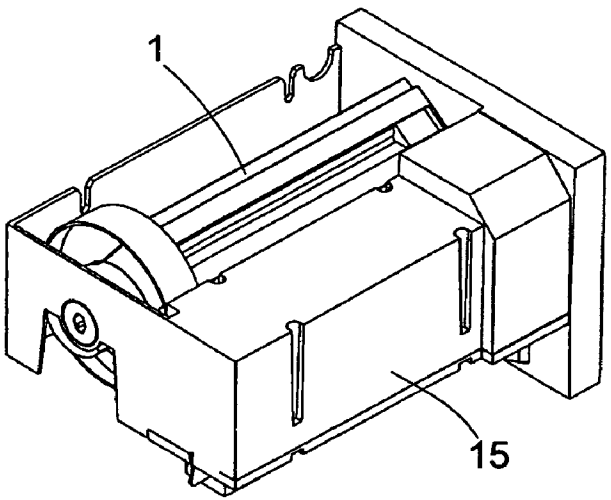
FIG. 10 shows a perspective view analogous to FIGS. 5 and 8 with the ice-maker tray in emptying setting.

A sensor 44 for detecting the rotational setting of the gearwheel 32 is mounted near this. It co-operates with a rib 45, which protrudes in axial direction from the edge of the flange 41 on a part of the circumference thereof so that it can enter into a slot at the rear side of the sensor housing. In the tilted setting of FIG. 6 the rib is covered for the greatest part by the sensor 44 and the oscillatory body 28. FIG. 7 differs from FIG. 6 in that the housing of the sensor 44 is shown in part cut away so that two light barriers 46, 47 bridging over the slot can be recognised in its interior. The rib 45 is disposed closely above the two light barriers 46, 47 so that a control electronic system, which is not illustrated, can recognise, on the basis of the fact that the two light barriers are open, that the tray 1 is disposed in the tilted setting and can stop the drive motor 22 in order to be able to keep the tray 1 in the tilted setting and fill it.

Figure 8:
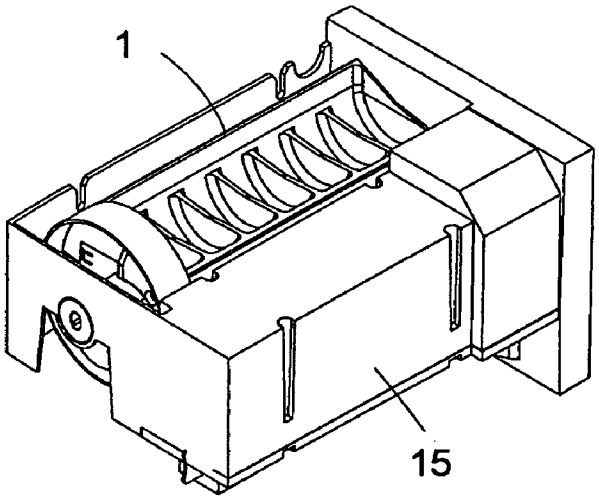
FIG. 8 shows a view, which is analogous to FIG. 5, with ice-maker tray in upright setting.

After a predetermined water quantity has been admetered to the tray 1 under the control of the control circuit the drive motor 22 is set in operation by the control unit in order to bring the tray 1 into the upright setting in which the water quantities in the compartments 4 of the tray 1 are cleanly separated from one another. This setting is shown in FIG. 8 in a perspective view corresponding with FIG. 5 and in FIG. 9 in a front view corresponding with FIG. 7. The gearwheel 25 is further rotated in clockwise sense relative to the setting of FIG. 7, although the same setting of the tray 1 can also be reached by rotation of the gearwheel 25 in counter-clockwise sense. Attainment of the upright setting is recognised when the rib 45 begins to block the lower light barrier 47.

The tray 1 remains in the upright setting for such a length of time until the water in the compartments 4 is frozen. The dwell time in the upright setting can be fixedly predetermined; alternatively, the control circuit can also be connected with a temperature sensor in order to be able to establish, on the basis of a measured temperature in the environment of the tray 1 and a characteristic curve stored in the control circuit, a respective time period sufficient in the case of the measured temperature for freezing the water.

Figure 11:
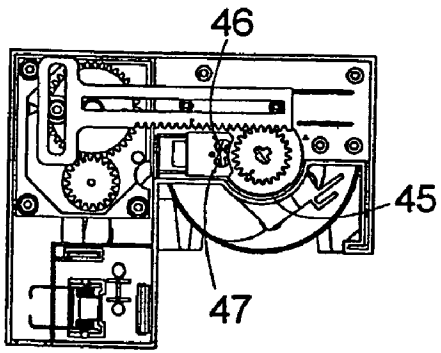
FIG. 11 shows a section analogous to FIGS. 7 and 9.
Figure 9:
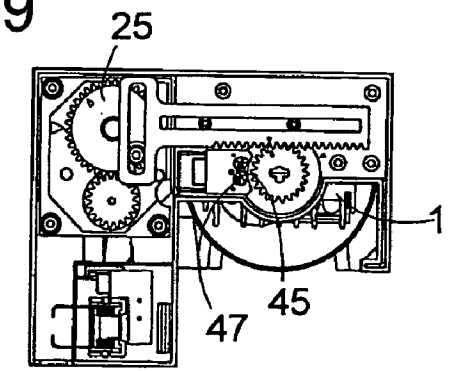
FIG. 9 shows a section, which is analogous to FIG. 7, with the ice-maker tray in upright setting.

After expiry of this time period the drive motor 22 is set back into operation in order to rotate the gearwheel 25 into the setting shown in FIG. 11, with the pin 26 in the 9 o'clock. The control circuit recognises that this position is reached when the two light barriers 46, 47 are again open. The rib 45 is now able to be clearly seen in the figure for a major part of its length.

In this setting the compartments 4 of the tray 1 are downwardly open so that the pieces of ice contained therein can drop out. The already mentioned electric heating device 13 is provided in order to facilitate release of the pieces of ice. As can be recognised in FIG. 12, this heating device 13 is an electric heating rod, which is bent into a loop and which extends in close contact with the tray 1 between heat exchange ribs 49 protruding at the underside thereof and is in part received in a groove 48 formed at the underside of the tray 1.

Through brief heating of the tray 1 with the help of the heating device 13 the pieces of ice in the compartments 4 are thawed at the surface. The water layer thus produced between the tray 1 and the pieces of ice acts as a slide film on which the pieces of ice are movable with very low friction. By virtue of the cross-sectional shape of the compartments 4 in the form of a segment of a cylinder the pieces of ice easily slide out of the compartments 4 and drop into a collecting container (not illustrated) arranged below the ice maker.

With the heating it is possible to begin so far ahead of pivoting the tray that the pieces of ice are already capable of sliding when pivoting in the tray is started; it can also be commenced at a later point in time, so that the pieces of ice are capable of sliding only when the tray is already pivoted. The second alternative has the advantage that no more ice is thawed than absolutely necessary, since the pieces of ice leave the warm tray as soon as they are free and then the action of the heating means 13 is stopped.

After emptying of the compartments 4, the drive motor is set back into operation and the gearwheel 25 further rotated in clockwise sense until it again reaches the setting shown in FIGS. 5 to 7 and a new operating cycle of the ice maker begins.

The invention claimed is:

1. An ice-maker tray comprising:

a plurality of compartments, wherein each compartment each has a form of a segment of a body of rotation, wherein the body of rotation includes a semi-cylindrical base having a continuous outer circumferential surface and a plurality of partition walls segmenting an interior of the semi-cylindrical base into the plurality of compartments, wherein the compartments are arranged in at least one row, wherein a wall of the semi-cylindrical base includes a portion that extends above an upper edge of the plurality of partition walls separating the compartments of the row from one another such that water filling the tray flows past the plurality of partition walls via the portion of the wall extending above the upper edge of the plurality of partition walls and into each of the plurality of compartments when the tray is pivoted into an inclined state in which the openings of the compartments face at an angle upward, and wherein the wall is formed at a longitudinal side of each row of compartments and at least a part of the transverse sides thereof.

2. The ice-maker tray according to claim 1, wherein the body of rotation is a cylinder.

3. The ice-maker tray according to claim 1, wherein the body of rotation segments of all compartments have parallel axes of rotation.

4. The ice-maker tray according to claim 1, wherein the wall protrudes at least 5 millimeters above the upper edge of the partition walls.

5. The ice-maker tray according to claim 1, wherein the number of rows is one.

6. The ice-maker tray according to claim 1, further comprising an electric heating device.

7. An ice-maker tray comprising:

a plurality of compartments, wherein each compartment each has a form of a segment of a body of rotation, wherein the body of rotation includes a semi-cylindrical base having a continuous outer circumferential surface and a plurality of partition walls segmenting an interior of the semi-cylindrical base into a plurality of compartments, wherein the compartments are arranged in at least one row, wherein a wall of the semi-cylindrical base includes a portion that extends above an upper edge of the plurality of partition walls separating the compartments of the row from one another such that water filling the tray flows past the plurality of partition walls via the portion of the wall extending above the upper edge of the plurality of partition walls and into each of the plurality of compartments when the tray is pivoted into an inclined state in which the openings of the compartments face at an angle upward, and wherein the wall is formed at a longitudinal side of each row of compartments and at least a part of the transverse sides thereof; and an electric heating device, wherein the electric heating device is a heating rod inserted between heat exchange ribs protruding from the tray.

8. An ice-maker comprising:

a frame; and a tray including a plurality of compartments with openings, wherein each compartment each has the form of a segment of a body of rotation, the tray being pivotable about an axis in the frame of the ice maker between an upright setting, in which the openings of the compartments face upwardly, and an emptying setting, in which the openings of the compartments face downwardly, wherein the body of rotation includes a semi-cylindrical base having a continuous outer circumferential surface and a plurality of partition walls segmenting an interior of the semi-cylindrical base into the plurality of compartments, wherein the compartments are arranged in at least one row, wherein a wall of the semi-cylindrical base includes a portion that extends above an upper edge of the plurality of partition walls separating the compartments of the row from one another such that water filling the tray flows past the plurality of partition walls via the portion of the wall extending above the upper edge of the plurality of partition walls and into each of the plurality of compartments when the tray is pivoted into an inclined state in which the openings of the compartments face at an angle upward, and wherein the wall is formed at a longitudinal side of each row of compartments and at least a part of the transverse sides thereof.

9. The ice-maker according to claim 8, wherein the pivot axis of the tray is the centre axis of a smallest cylinder enclosing the tray.

10. The ice-maker according to claim 8, wherein the upper edges of the partition walls lie above the pivot axis in the upright and the tilted setting.

11. The ice-maker according to one of claim 8, wherein the tray is fixed in a tilted setting in which the partition walls are inclined towards the longitudinal side having the protruding wall.

12. A method for operating an ice maker comprising a frame and a tray including a plurality of compartments with openings, wherein each compartment each has the form of a segment of a semi-cylindrical body of rotation, the tray being pivotable about an axis in the frame of the ice maker between an inclined state in which the opening of the compartment faces at an angle upward for filing with water, an upright setting, in which the openings of the compartments face upwardly, and an emptying setting, in which the openings of the compartments face downwardly, wherein the semi-cylindrical body of rotation includes a semi-cylindrical base having a continuous outer circumferential surface and a transverse wall at each end of the semi-cylindrical base forming a continuous semi-cylindrical compartment within the semi-cylindrical base; and a plurality of partition walls segmenting a portion of an interior of the semi-cylindrical base into a plurality of semi-cylindrical sub-compartments the plurality of compartments, the plurality of partition walls including coplanar upper edges, the semi-cylindrical base including a portion that extends above the coplanar upper edges of the plurality of partition walls, the transverse wall including a first portion having a first upper edge that is coplanar with the coplanar upper edges of the plurality of partition walls, and the transverse wall including a second portion having a second upper edge that is angled with respect to the coplanar upper edges of the plurality of partition walls and that extends above the coplanar upper edges of the plurality of partition walls, the method comprising:

pivoting the tray about an axis, which is parallel to the axis of the body of rotation segments of the compartment, into the inclined state in which the openings of the compartments face at an angle upward for filing the compartments with water;

filling the compartments with water such that the water flows past the plurality of partition walls via the wall extending above the upper edge of the plurality of partition walls and into each of the plurality of compartments;

pivoting the tray about the axis into the upright setting, in which the openings of the compartments face upwardly and the upper edge of the plurality of partition walls extend substantially horizontally, such that the plurality of partition walls separate the water into separate compartments without flowing over the upper edge of the plurality of partition walls;

freezing the water into pieces of ice within the compartments of the tray;

allowing a surface of the pieces of ice to thaw; and pivoting the tray about the axis into a setting in which the openings of the compartments face downwardly to empty the pieces of ice from within the compartments.

13. An ice-maker tray comprising:

a semi-cylindrical body of rotation, wherein the semi-cylindrical body of rotation includes a semi-cylindrical base having a continuous outer circumferential surface and a plurality of partition walls segmenting an interior of the semi-cylindrical base into a plurality of compartments, wherein the plurality of compartments are arranged in at least one row, wherein the semi-cylindrical body of rotation includes a wall having a portion extending above an upper edge of each of the plurality of partition walls separating the plurality of compartments of the at least one row from each other such that water filling the tray flows past the plurality of partition walls via the portion of the wall extending above the upper edge of the plurality of partition walls and into each of the plurality of compartments when the tray is pivoted into an inclined state in which the openings of the compartments face at an angle upward, wherein the wall is formed at a longitudinal side of the at least one row of the plurality of compartments, and wherein at least a part of the wall is formed at transverse sides of each end compartment of the plurality of compartments.

14. The ice-maker tray of claim 13, wherein each of the plurality of compartments has a parallel axis of rotation.

15. The ice-maker tray of claim 13, wherein the wall protrudes at least 5 millimeters above the upper edge of the plurality of partition walls.

16. The ice-maker tray of claim 13, further comprising:

an electric heating device.

17. An ice-maker tray comprising:

a semi-cylindrical body of rotation, wherein the semi-cylindrical body of rotation includes a semi-cylindrical base having a continuous outer circumferential surface and a plurality of partition walls segmenting an interior of the semi-cylindrical body of rotation into a plurality of compartments, wherein the plurality of compartments are arranged in at least one row, wherein the semi-cylindrical body of rotation includes a wall having a portion extending above an upper edge of each of the plurality of partition walls separating the plurality of compartments of the at least one row from each other such that water filling the tray flows past the plurality of partition walls via the portion of the wall extending above the upper edge of the plurality of partition walls and into each of the plurality of compartments when the tray is pivoted into an inclined state in which the openings of the compartments face at an angle upward, wherein the wall is formed at a longitudinal side of the at least one row of the plurality of compartments, and wherein at least a part of the wall is formed at transverse sides of each end compartment of the plurality of compartments;

an electric heating device; and heat exchange ribs protruding from an underside of the body of rotation, wherein the electric heating device is a heating rod inserted between the heat exchange ribs.

18. An ice-maker tray comprising:

a semi-cylindrical body of rotation, wherein the semi-cylindrical body of rotation includes:

a semi-cylindrical base having a continuous outer circumferential surface and a transverse wall at each end of the semi-cylindrical base forming a continuous semi-cylindrical compartment within the semi-cylindrical base;

a plurality of partition walls segmenting a portion of an interior of the semi-cylindrical compartment into a plurality of semi-cylindrical sub-compartments, wherein the plurality of partition walls include coplanar upper edges, wherein the semi-cylindrical base includes a portion that extends above the coplanar upper edges of the plurality of partition walls such that water filling the tray flows past the plurality of partition walls via the portion extending above the coplanar upper edges of the plurality of partition walls and into each of the plurality of compartments when the tray is pivoted into an inclined state in which the openings of the compartments face at an angle upward, wherein the transverse wall includes a first portion having a first upper edge that is coplanar with the coplanar upper edges of the plurality of partition walls, and wherein the transverse wall includes a second portion having a second upper edge that is angled with respect to the coplanar upper edges of the plurality of partition walls and that extends above the coplanar upper edges of the plurality of partition walls.

19. The ice-maker tray of claim 18, wherein the continuous outer circumferential surface includes:

a first planar surface that is parallel to the coplanar upper edges of the plurality of partition walls and the first upper edge of the transverse wall; and a second planar surface that is parallel to the second upper edge of the transverse wall.

* * * * *